United States Patent [19]

Wandler

[11] 4,156,902

[45] May 29, 1979

[54] LATCH ASSEMBLY FOR REMOVABLY SECURING ELECTRICAL COMPONENT TRAY IN LIGHT FIXTURE HOUSING

[75] Inventor: Donald Wandler, South Milwaukee, Wis.

[73] Assignee: McGraw-Edison Company, Elgin, Ill.

[21] Appl. No.: 823,387

[22] Filed: Aug. 10, 1977

[51] Int. Cl.[2] ..... F21J 7/00

[52] U.S. Cl. ..... 362/307; 362/362

[58] Field of Search ..... 362/307, 362

[56] References Cited

U.S. PATENT DOCUMENTS 4,019,044 4/1977 Kelly et al. ..... 362/307

*Primary Examiner*—Stephen J. Lechert, Jr.

*Attorney, Agent, or Firm*—Jon C. Gealow; Thomas E. McDonald; Bruce R. Mansfield

[57] ABSTRACT

A latch assembly for removably securing an elongated electrical component tray in the housing of a light fixture comprises a bracket member having spaced side walls from which support members extend, respectively, in opposing relation toward the housing interior. A first one of the support members includes a plurality of alternately offset fingers between which a first end of the tray is received. A flat spring member mounted on the opposite bracket wall, transverse the second support member, defines a slotted aperture through which the second one of the mounting members extends. The spring member includes a cam surface for engagement by the second end of the tray to urge the spring away, permitting the tray end to be moved past the cam surface and be received in the slotted aperture for retaining the second end of the tray on the second support member. Release of the tray requires manual movement of the spring member for removal of the second end of the tray from within the slotted aperture.

8 Claims, 5 Drawing Figures

LATCH ASSEMBLY FOR REMOVABLY SECURING ELECTRICAL COMPONENT TRAY IN LIGHT FIXTURE HOUSING

BACKGROUND OF THE INVENTION

This invention relates generally to a light fixture of the type wherein the electrical components are mounted on a removable tray and more particularly to a latching arrangement for quickly installing and removing such tray from the fixture housing.

With the advent of light fixtures of the type illustrated in U.S. Pat. No. 4,019,044 issued Apr. 19, 1977, in the names of J. P. Kelly et al., and assigned to the same assignee as the instant invention, which include a removable tray on which the lamp ballast and lamp socket are mounted, easy replacement of the electrical components of the fixture is made possible. In such a light fixture, however, the tray is conventionally secured in the housing by means of screws or the like fasteners. While these fasteners serve to satisfactorily mount the component tray in position in the fixture housing, in some cases, such as, for example, where the light fixture is mounted in a location which is not easily accessible, it may become difficult for a repairman to change the tray, especially while he is supported on a ladder or similar structure.

SUMMARY OF THE INVENTION

Accordingly, it is a primary object of the present invention to provide in a light fixture wherein the electrical components are mounted on a removable tray, an improved releasable latch assembly for removably securing the tray in the housing.

It is another object of the present invention to provide a latch assembly of the above-described type which is simple in design, efficient in operation and relatively inexpensive to fabricate.

Briefly, a preferred embodiment of the latch assembly according to the invention includes a bracket member mounted in the light fixture housing. A pair of mounting or support members extend in opposing relation from opposite side walls of the bracket in the housing interior. A first one of the members includes a plurality of finger portions alternately offset from each other for receipt of a first end of the component tray therebetween. A flat spring member is mounted on the opposite side wall of the bracket. The spring member defines a slotted aperture through which the second one of the mounting members extends. The spring member which is biased toward the first one of the mounting members, includes a cam surface contoured for engagement by a tongue portion formed at the opposite end of the tray, whereby the spring member is urged against the biasing force to permit the tongue portion to be received in the slotted aperture in engagement with the second one of the mounting members. Once the tongue portion is moved past the cam surface and received in the aperture, the flat spring member returns to its normal position to retain the tray in place on the opposing mounting members.

In a preferred embodiment the component tray takes the form of a U-shaped channel member with the bight portion extending the length thereof. When the tray is positioned on the mounting members, the first and second legs of the U are located on opposite sides of the first mounting member to limit the lateral movement of the tray with respect thereto. The opposite end of the tray defines cutouts on opposite sides of the tongue portion in which edges formed on the spring member are received to limit the lateral movement of the tray at the second mounting member.

Removal of the tray requires the spring member to be moved manually against the biasing force thereof to first remove the second end of the tray from within the slotted aperture. Thereafter the opposite end of the tray is removed from between the offset finger portion so that the tray can be lifted from engagement with the mounting members. Fold-away handles on the tray member aid in the removal.

DETAILED DESCRIPTION OF THE DRAWINGS

Figure 1:
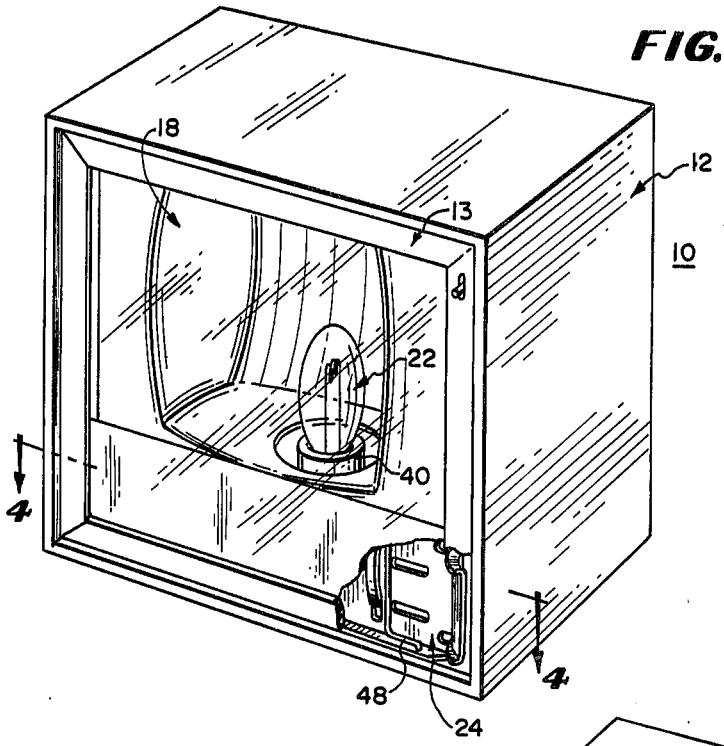
FIG. 1 is a partially cut away perspective view of a light fixture of the type having a removable tray on which the electrical components are mounted, including a latch assembly according to the invention for removably securing the component tray in the housing.
Figure 2:
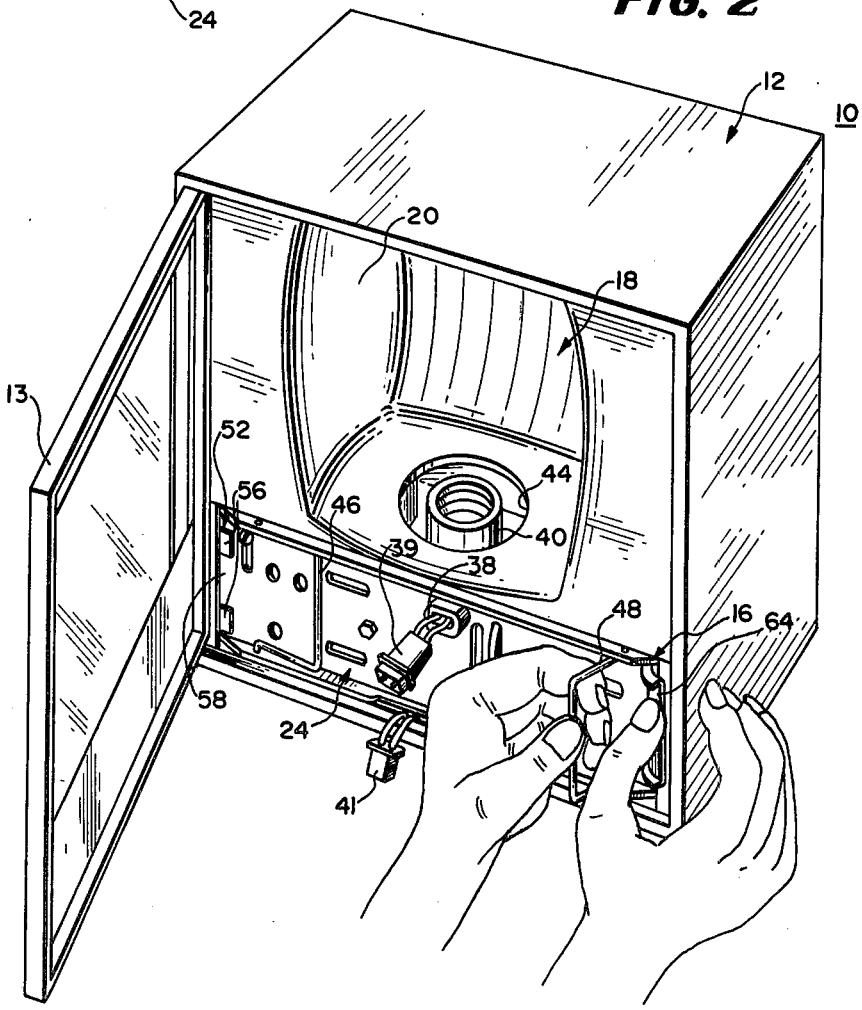
FIG. 2 is a perspective view of the light fixture of FIG. 1 shown with the cover glass in an open condition, illustrating the manner of removal of the component tray by release of the latch assembly according to the invention.
Figure 3:
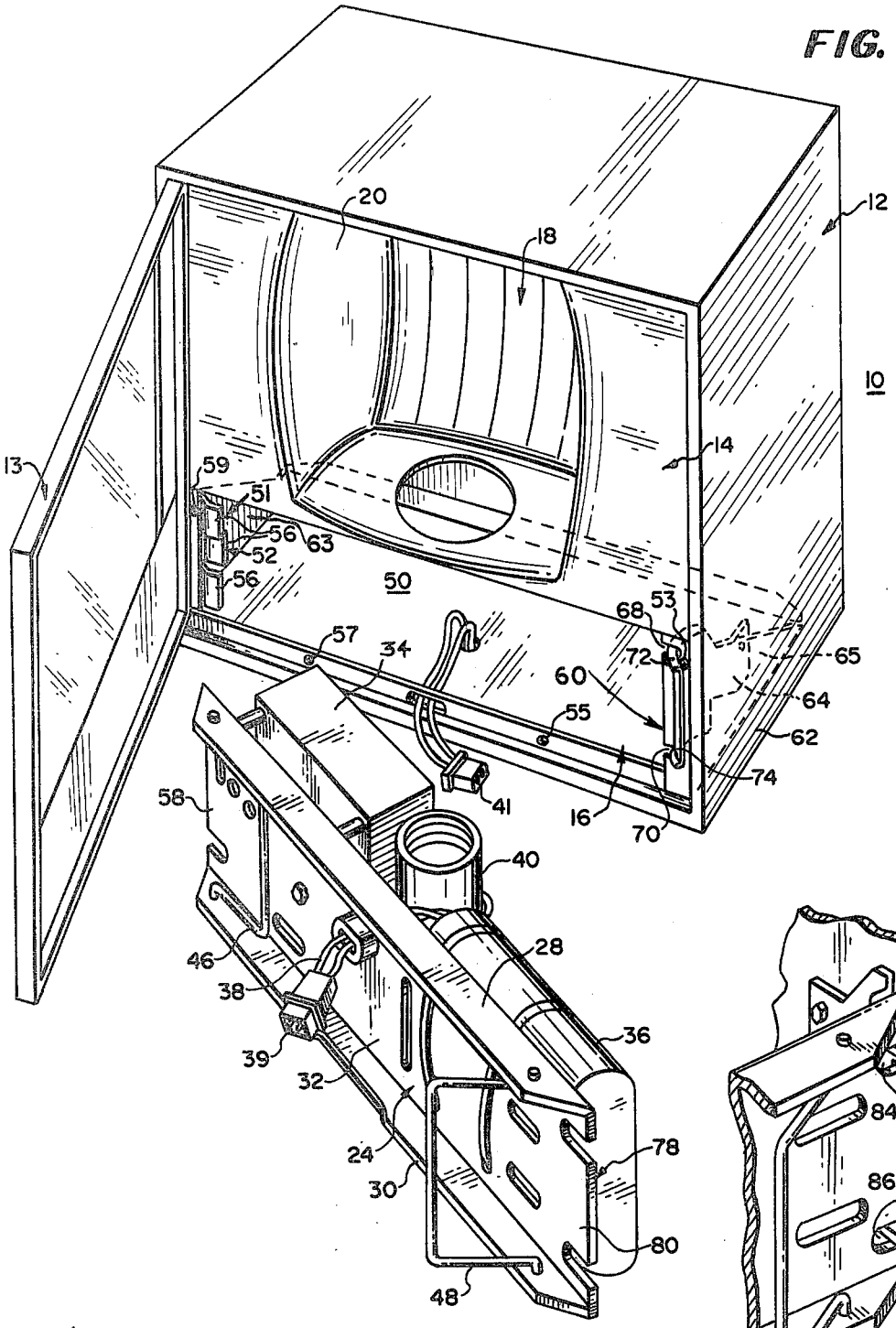
FIG. 3 is a perspective view of the light fixture of FIGS. 1 and 2 with the component tray removed.
Figure 5:
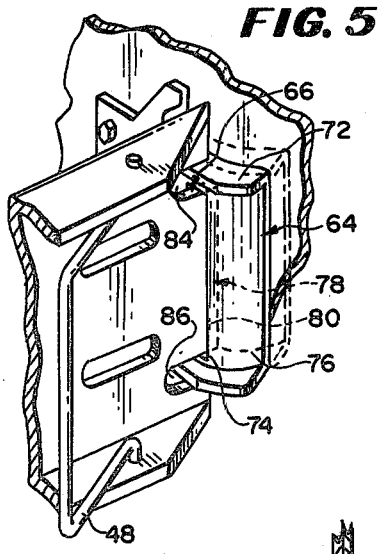
FIG. 5 is an enlarged, fragmentary perspective view of the resilient spring member of the latch assembly according to the invention employed for releasably securing the component tray in the light fixture housing.

Referring now to the drawings in greater detail wherein like numerals have been employed through the various views to designate similar components, there is illustrated in FIGS. 1–3, a light fixture designated generally by the numeral 10 including an outer housing 12 formed of a suitable material, such as, for example, aluminum and a hingedly mounted glass cover forming the front wall thereof. The housing interior is divided into two compartments, 14, 16. An appropriate optical assembly 18 is mounted in compartment 14. The optical assembly includes reflective walls such as 20 for reflecting light emitted by a lamp 22 (FIG. 1) positioned adjacent thereto. The lamp 22 can be of any suitable type, but when the light fixture is employed as a floodlight, the lamp is preferably of a high intensity discharge type.

Figure 4:
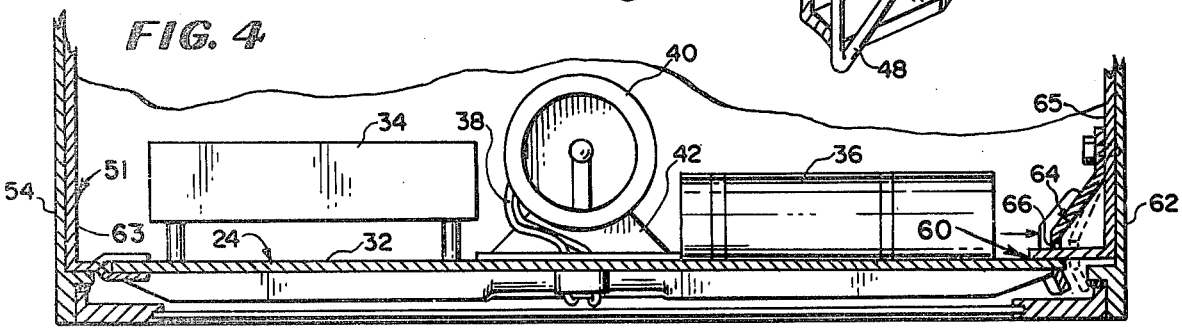
FIG. 4 is a cross sectional view of the light fixture of FIG. 1 taken along the line 4—4 illustrating in greater detail the removable component tray thereof.

An electrical component mounting tray 24 is mounted in compartment 16 of the housing. The tray is formed of a generally U-shaped channel member of a predetermined length having legs 28, 30 and an elongated bight 32 (see FIG. 3). In the particular embodiment shown, all of the electrical components for the light fixture are mounted on the outer surface of the bight of the mounting tray 24. The components include a ballast, such as an auto transformer 34, a capacitor 36, suitable wiring 38 terminating in a connector 39 and lamp socket 40 mounted on the tray by means of a suitable bracket 42 (FIG. 4).

Lamp 22, FIG. 1, is received in the socket 40 after the component tray is in place in compartment 16 of the housing. The lamp, as can be seen, would have to be removed in order to insert or remove the electrical component mounting tray 24 in compartment 16 of the housing. Once the tray is in position in the housing, the base of the lamp 22 is passed through aperture 44 (FIG. 2) in the optical assembly 18 for receipt in the socket 40.

On the inner surface of bight 32 of the U-shaped channel member of tray 24, there is provided a pair of handles 46, 48, used to hold the tray when inserting or removing it from compartment 16 of the light fixture housing. The handles are pivotal so that they can be moved into an overlying, stored position with respect to the bight 32 of the tray after the tray is positioned in the housing. Handle 46 is shown in such position in the drawings.

A latch assembly 50 according to the invention is provided to removably secure the component tray 16 in the light fixture housing. The latch assembly 50 includes a bracket 51 formed of sheet metal, fastened by screws, such as 53, 55, 57 and 59 to an edge or lip 61 formed on and extending about the front opening of the housing. A first mounting or support member 52 extends inwardly of the housing from a fixed side wall 63 of the bracket. In the case of the rectangular shaped housing as shown the side wall 63 of bracket 51 extends substantially parallel to the side wall 54 of the housing. The support member includes a plurality of spaced fingers 56 alternately offset from each other to receive a first end 58 of the bight portion of tray 16 therebetween (see FIGS. 2 and 3). When end 58 of the tray is received on support member 52, the legs of the U-shaped tray are located on opposite sides thereof (FIG. 2) to limit the lateral movement of the tray with respect to the support member 52.

A second support member 60 extends inwardly of the housing from an opposite side wall 65 of the bracket. Bracket side wall 65 is in the embodiment of the light fixture housing shown, positioned in substantially parallel alignment with respect to the opposite housing wall 62. The support member 60 extends in opposing relation to support member 52. The distance between support members 52, 60 is slightly less than the length of bight 32 of tray 24. A spring member 64 is also mounted on the bracket side wall 65 and extends therealong. The spring member includes a slotted aperture 66 through which the second support member 60 extends (FIG. 3). The support member 60 includes cut-outs 68, 70 (FIG. 3) for receipt of edges 72, 74 formed on the spring member. The spring member includes a contoured or curved cam surface 72, the function of which will be described hereinafter. The support and spring member combination (60, 64) serve to secure end 78 of the tray on support member 60.

End 78 of the tray includes a tongue portion 80 which is received in slotted aperture 66 of the spring member and is held thereby on support member 60, to retain the component tray in compartment 16 of the housing.

To mount component tray 24 in position in compartment 16 of the light fixture housing, the tray is held in the operator's hands by the two pivotal handles 46, 48 and maneuvered to insert the electrical components mounted on bight 32 into the housing compartment. End 58 of the tray is received between offset fingers 56 of the support member 52. Thereafter, the opposite end 78 of the tray is swung about toward the cam surface 76 of the spring member 64. The tongue portion 80 is received between edges 72, 74 of the spring member and is forced against the cam surface 76, urging the spring member away from end 78 of the tray. The movement of the spring member is illustrated in solid and dashed lines in FIG. 4 of the drawings. End 78 of the tray cams over the surface 76 until the tongue portion 80 is aligned with slotted aperture 66 in the spring member. At that time, the spring member is urged by the biasing force thereof toward end 78 of tray 24 to capture tongue portion 80 in the slotted aperture. End 78 of the tray at this time engages support member 60.

As can be seen in the drawings, a pair of cut-outs 84, 86 are defined in bight 32 of the tray 24 on opposite sides of tongue portion 80. The cut-outs are spaced from each other to receive edges 72, 74 of the spring member, thereby limiting the lateral or sidewise movement of end 78 of the tray on support member 60.

Once the tray 24 is latched into position in the housing compartment 16, connector portion 39 extending from tray 24 and connector portion 41 extending from the light fixture housing to a source of power (not shown) are joined to power the components on the tray. Thereafter, a lamp 22 is inserted into aperture 44 in the optical assembly 18 and screwed into socket 40 on the tray.

To remove the tray from the housing for the purpose of changing electrical components, etc., the lamp 22 is first unscrewed from socket 40. Next, the connectors 39, 41 are separated. Thereafter, handle 48 is held in one hand by the operator and the other hand is used to move spring member 64 against the biasing force thereof away from end 78 and tongue 80 of the tray (see FIG. 2). When the spring member has been moved sufficiently to permit tongue portion 80 to be released from slotted aperture 66 in the spring member, end 78 of the tray can be swung from the housing. Thereafter, the right hand (as seen in the drawings) is used to hold bracket 48 while the left hand grips the bracket 46. End 58 of the tray is lifted away from fingers 56 of the support member 52 and the tray is removed from housing compartment 16.

As can be seen from the above description, the latching assembly according to the invention provides a relatively simple yet efficient means of removably securing the electrical component tray of the light fixture in the housing compartment. No screws or fasteners are required and as such no special tools are needed to remove or replace the electrical component tray.

While a particular embodiment of the invention has been shown and described, it should be understood that the invention is not limited thereto since many modifications may be made. It is therefore contemplated to cover by the present application any and all such modifications as fall within the true spirit and scope of the appended claims.

I claim:

1. In a light fixture including an outer housing having a lamp mounted therein, and a compartment for receiving an electrical component tray, said tray comprising a plate on which electrical components of the light fixture are mounted said electrical components being connectable electrically to said lamp, a latch assembly for removably securing said tray in said housing, said latch assembly including in combination:

first and second support members extending inwardly into said housing from opposite sides thereof in opposing relation, a first one of said support members including means for receiving a first end of said tray, a spring member mounted adjacent said second support member and extending transverse thereto, said spring member being generally flat and defining a slotted aperture through which said second support member extends, said spring member being resiliently biased toward a first position in the direction of said first support member and movable against said biasing force in the opposite direction to a second position, and including a cam surface for engagement by the second end of said tray for moving said spring member toward the second position to permit said second end of said tray to be mounted on said support member, said spring member being returned to said first position by said biasing force to capture said second end of said tray in said slotted aperture for securing said tray on said support members.

2. A latch assembly as claimed in claim 1 wherein said tray comprises a U-shaped channel member having an elongated bight portion, the electrical components of said light fixture being mounted on one surface of said bight portion, wherein said first one of said support members includes a plurality of offset fingers spaced to receive a first end of said bight portion therebetween, and wherein the opposite end of said bight portion defines a tongue dimensioned for receipt in said slotted aperture in said spring member.

3. A latch assembly as claimed in claim 1 further including a bracket having first and second spaced side walls mounted in said light fixture housing, said first and second support members extending in opposing relation from said first and second bracket side walls, respectively, wherein said component tray is of a predetermined length, slightly greater than the distance between said support members, whereby said tray is mountable in an overlying relation with respect to said support members and wherein said spring member is mounted on said second bracket side wall extending outwardly therefrom.

4. A latch assembly as claimed in claim 2 wherein said bight portion defines a pair of cut-outs on opposite sides of said tongue, wherein said spring member includes raised edges formed along opposite sides thereof and wherein said raised edges are located for receipt in said cut-outs upon mounting said component tray on said support members, whereby the lateral movement of the second end of said tray is limited on said second support member.

5. A latch assembly as claimed in claim 4 wherein the legs of said U-shaped channel member are spaced for location on opposite sides of said first support member upon mounting said component tray on said support members, thereby to limit the lateral movement of the first end of said tray with respect to said first support member.

6. In a light fixture including an outer housing having a lamp mounted therein, and a section for receiving an electrical component tray, said tray being U-shaped and having an elongated bight portion of a predetermined length, the electrical components being connectable electronically to said lamp and mounted on one surface of said bight portion, a latch assembly for removably securing said tray in said housing, said latch assembly including in combination:

a bracket having a predeterminedly spaced side walls mounted in said housing, said bracket including first and second support members extending from said side walls respectively, in opposing relation, said first support member including means for receiving a first end of the bight portion of said tray, a flat spring member mounted on said second bracket side wall and extending generally transverse said second support member, said flat spring member defining a slotted aperture through which said second support member passes, said spring member being biased to a first position toward said first support member and including a cam surface for engagement by the second end of said bight portion of said tray for moving said spring member away from said first position to a second position, permitting said second end of the bight portion of said tray to engage said support member in an overlying manner, said spring member being returned to said first portion to capture the second end of said bight portion of said tray in said slotted aperture on said second support member to secure said tray in said housing.

7. A latch assembly as claimed in claim 6 wherein said first support member receiving means includes a plurality of offset fingers spaced to receive a first end of the bight portion of said tray, wherein the opposite end of said bight portion of said tray defines a tongue dimension for receipt in a slotted aperture of said spring member, said opposite end of said bight portion defining cut-outs on opposite sides of said tongue and wherein said spring member includes raised edges on opposite sides of said slotted aperture dimension for receipt in said cut-outs, respectively, upon mounting said tray on said support members, thereby to limit the sidewise movement of said tray in said housing.

8. A latch assembly as claimed in claim 7 wherein the legs of the U-shaped electrical component tray are spaced predeterminedly for location on opposite sides of said first support member upon mounting said first end of said bight portion thereon, thereby to limit the sidewise movement of said tray in said housing.

* * * * *